US010060697B2

(12) United States Patent
Boelens

(10) Patent No.: US 10,060,697 B2
(45) Date of Patent: Aug. 28, 2018

(54) PROTECTION DEVICE AND METHODS

(71) Applicant: Daniel F. Boelens, Grand Rapids, MI (US)

(72) Inventor: Daniel F. Boelens, Grand Rapids, MI (US)

( * ) Notice: Subject to any disclaimer, the term of this patent is extended or adjusted under 35 U.S.C. 154(b) by 261 days.

(21) Appl. No.: 14/933,170

(22) Filed: Nov. 5, 2015

(65) Prior Publication Data

US 2016/0131452 A1 May 12, 2016

Related U.S. Application Data

(60) Provisional application No. 62/076,147, filed on Nov. 6, 2014.

(51) Int. Cl.

| | |
|---|---|
| ***B26B 1/04*** | (2006.01) |
| ***F41B 15/08*** | (2006.01) |
| ***F41B 15/02*** | (2006.01) |

(52) U.S. Cl.

CPC ..... *F41B 15/08* (2013.01); *F41B 15/02* (2013.01)

(58) Field of Classification Search

CPC ..... F41B 15/02

See application file for complete search history.

(56) References Cited

U.S. PATENT DOCUMENTS 4,356,631 A * 11/1982 Guth ..... B26B 1/046 30/152
4,739,990 A * 4/1988 Aguirre ..... F41B 15/02 463/47.3
5,863,251 A * 1/1999 Fusco ..... F41B 15/02 463/47.2
2001/0019967 A1* 9/2001 Taylor ..... F41B 15/02 463/47.2
2010/0276514 A1* 11/2010 Stethem ..... F41B 15/02 239/289
2011/0130207 A1* 6/2011 Hasenyager ..... F41B 15/00 463/47.2

OTHER PUBLICATIONS

"EKT G-10 Push Dagger Knife (2.5" Plain)". From bladeplay.com via The Way Back Machine (www.archive.org). [dated Jul. 18, 2014]. [online], [retrieved on Nov. 13, 2017]. Retrieved from the Internet <URL: https://web.archive.org/web/20140718122118/https://www.bladeplay.com/item--EKT-G-10-Push-Dagger-Knife-2-Plain--8356>. 1 page.* www.knifecenter.com/kc_newstore_store.html?tti=Push%20knives&b=push&, Dec. 27, 2014.

www.knifecenter.com/item/CS12CS/cold-steel-12cs-safe-maker-ii-push-dagger-blade-kray-ex-handle, Dec. 27, 2014.

www.botach.com/products/surefire-ew-14-push-dagger.html, Dec. 27, 2014.

* cited by examiner

*Primary Examiner* — Lawrence Galka

(74) *Attorney, Agent, or Firm* — Mitchell Intellectual Property Law, PLLC

(57) ABSTRACT

A protective device includes a grip having a non-slip surface, a stake projecting from said grip and terminating in a blunt point, point; and a flexible loop projecting from said grip, which is sufficiently long that a user can loop it over a finger to attach the device to the user's hand, and such that it all user's repositioning of the device in a user's palm, whereby the device can be generally concealed within a user's palm, but shifted within his or her palm such that said point of said stake is exposed and can be directed against an attacker to inflict pain and discourage further advances.

19 Claims, 6 Drawing Sheets

PROTECTION DEVICE AND METHODS

CROSS REFERENCE TO RELATED APPLICATION

This application claims priority to U.S. Provisional Application Ser. No. 62/076,147, filed Nov. 6, 2014, entitled PROTECTION DEVICE AND METHODS.

BACKGROUND

The present invention relates to nonlethal personal protective devices. Such devices are used to ward off attackers. They are considered nonlethal in that their use typically does not result in death of the attacker, though it is recognized that almost any device can be lethal if properly or accidentally directed, for example into an attacker's temple. Nevertheless, such devices are usually considered nonlethal and often sufficiently so that they can be carried on an airplane.

So-called tactical pens are one example of such devices. Tactical pens look like ordinary pens, but their non-retractable points are intended for inflicting pain when directed against an attacker, in order to deter the attacker. Self-defense key chains are available which include pointed projections which can be directed against an attacker to inflict pain.

Other such protective devices include stun guns and pepper sprays. These, however, are generally not permitted as carry-on items for air travel.

SUMMARY OF THE INVENTION

The nonlethal protective device of the present invention comprises a grip, a stake projecting from the grip, and a flexible loop sufficiently long that a user can loop it over a finger to attach the device to the user's hand. Preferably the loop is sufficiently long, that it allows repositioning of the device in a user's palm. This allows the device to be generally concealed within a user's palm, while still allowing the user to shift the device within his or her palm such that the point of the stake can be directed against an attacker to inflict pain and discourage further advances.

These and other objects, uses and advantages of the invention will be more fully understood and appreciated by reference to the description of the preferred embodiments, including the appended drawings.

DESCRIPTION OF THE PREFERRED EMBODIMENTS

Figure 1:
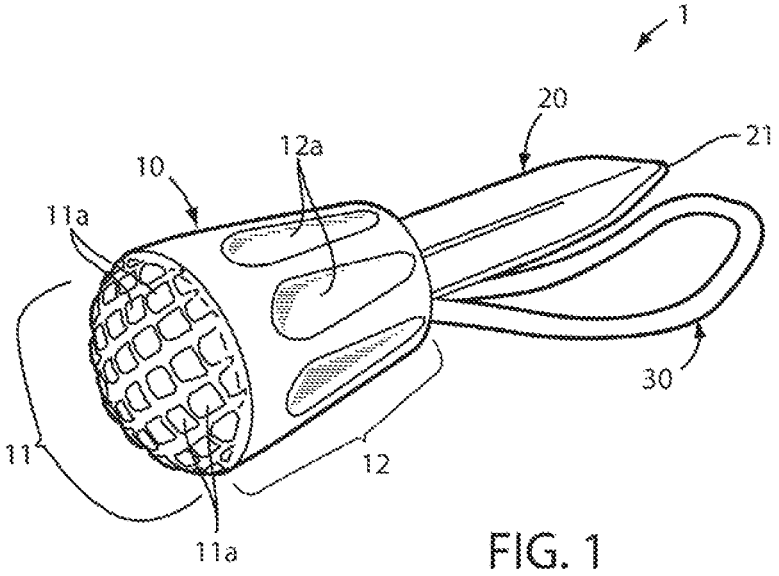
FIG. 1 is a perspective view of a preferred embodiment protective device in accordance with the present invention.
Figure 2:
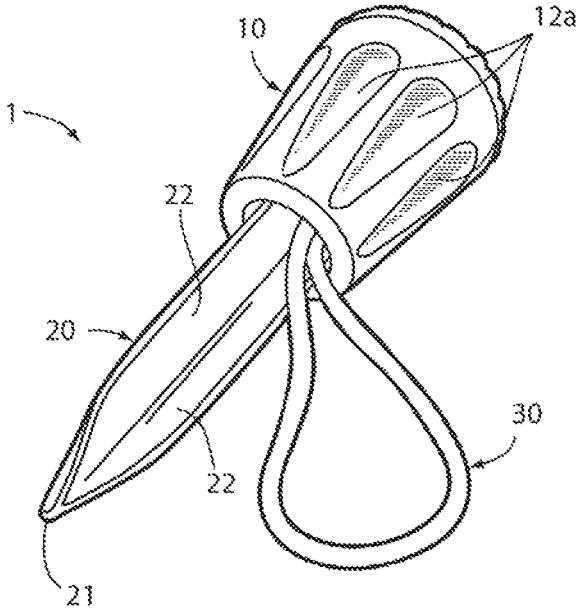
FIG. 2 is a reversed perspective view of the protective device of FIG. 1.
Figure 6:
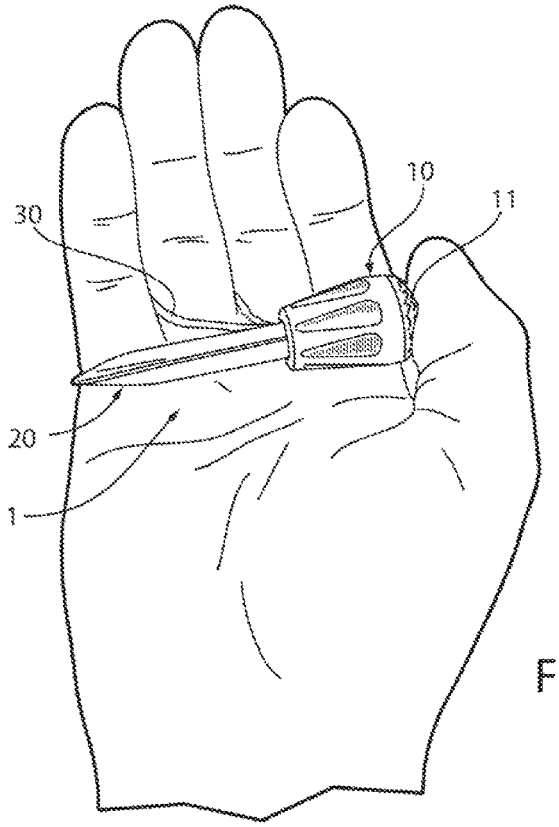
FIG. 6 is a perspective view of a protective device being held in the palm of a user's hand.
Figure 7:
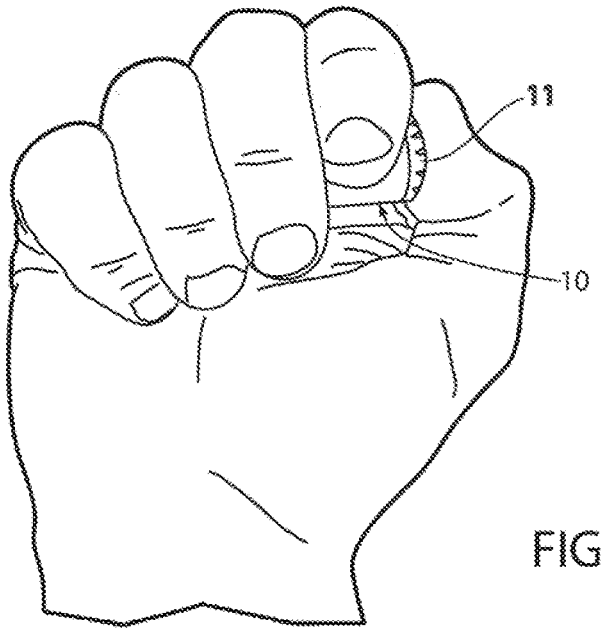
FIG. 7 is a perspective view showing a user's hand closed over the protective device so as to generally conceal it.

In the preferred embodiments, protective device 1 comprises a grip 10, a stake 20 projecting from grip 10, and a loop 30 extending from grip 10 (FIGS. 1, 2). Protective device 1 can be located laterally across a user's palm (FIG. 6), with loop 30 looped around one of the user's fingers and the user's thumb resting against the top 11 of grip 10 (FIG. 6). Preferably, protective device 1 has an overall length such that it extends laterally across a portion of the width of a user's hand at the palm and fingers (6), but can be completely concealed within the user's closed fist (FIG. 7). By pressing his or her thumb against top 11 of grip 10, the user can push the pointed end 21 of stake 20 beyond the width of his or her grip (FIG. 8), and jab point 21 into an attacker.

Figure 9:
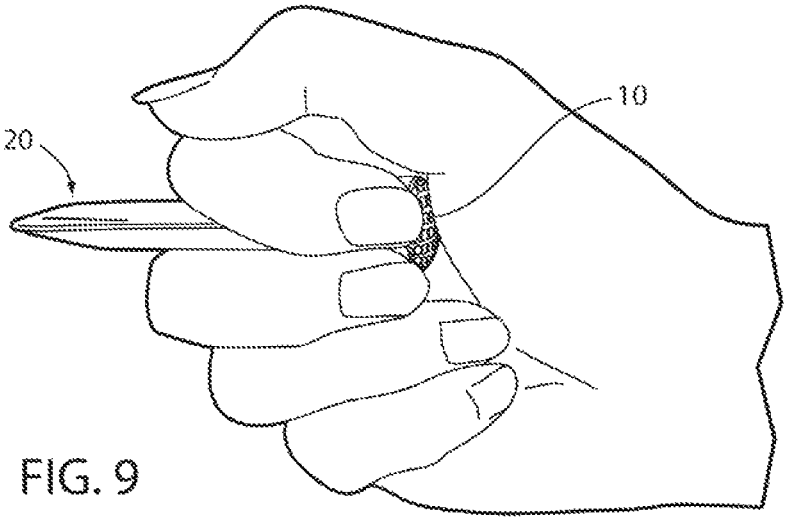
FIG. 9 is a perspective view of the protective device positioned in a user's hand such that the blunt pointed end projects between the user's fingers.

Alternatively, protective device 1 can be oriented with the top 11 of grip 10 resting against that portion of the palm at the base of the thumb, with stake 20 projecting from between the user's fingers (FIG. 9). Loop 30 will still be looped around the user's finger, though it is not visible in FIG. 9. In that orientation, protective device 1 can be used against an attacker in a jabbing motion.

Figure 10:
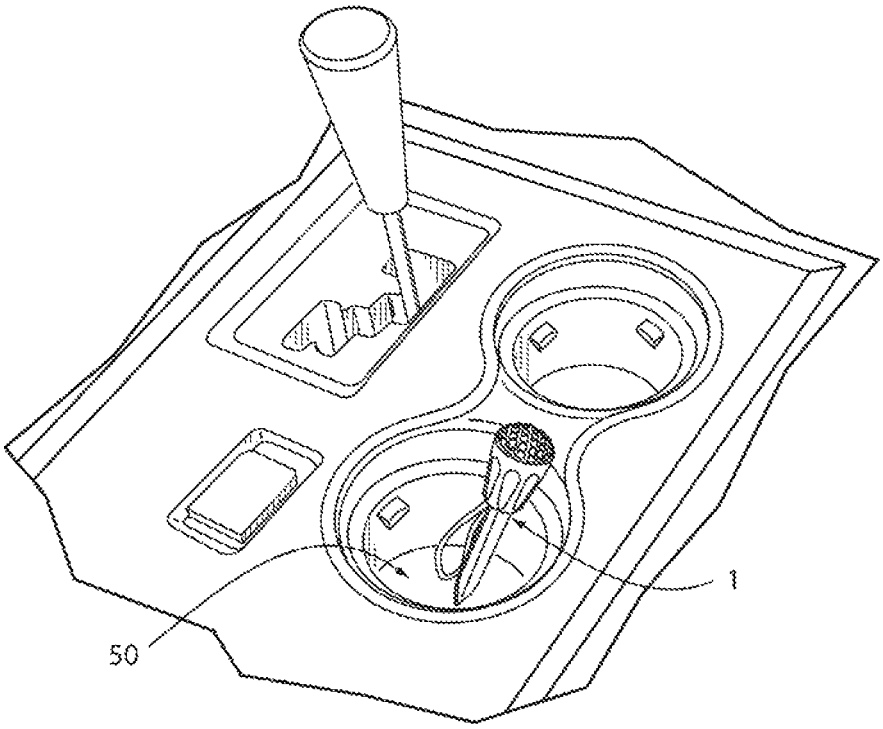
FIG. 10 is a perspective view showing the protective device within a cup holder of a vehicle.
Figure 11:
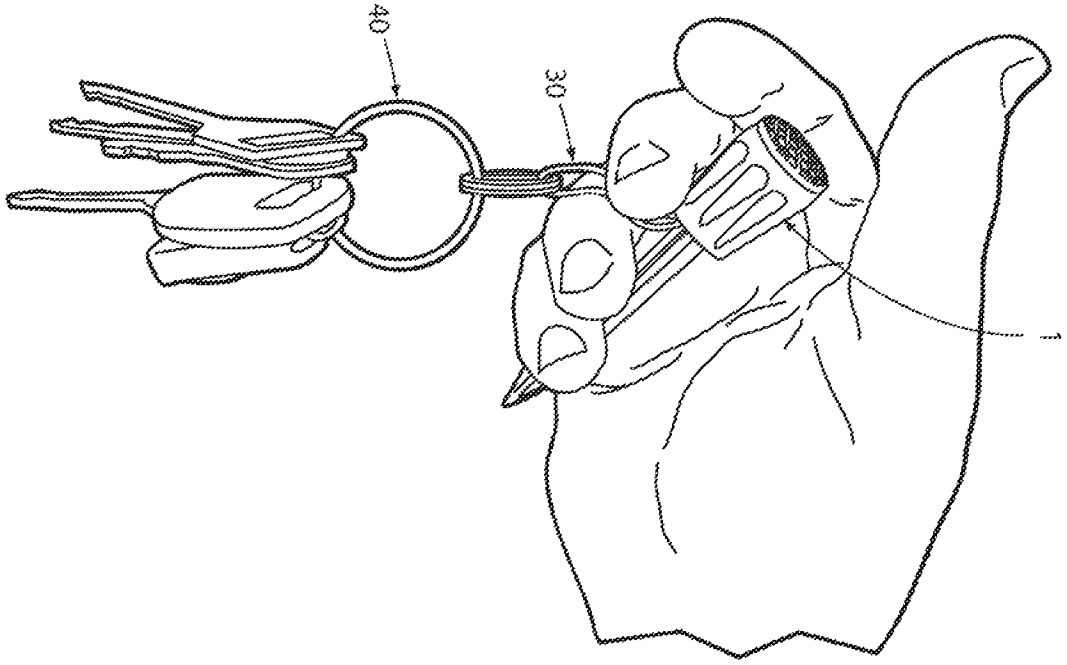
FIG. 11 is a perspective view showing the protective device attached to a key chain.

Loop 30 can also be used to connect device 1 to the user's key chain or key ring 40 (FIG. 11). Alternatively, protective device 10 can be conveniently carried in the cup holder of a user's car (FIG. 10).

Figure 4:
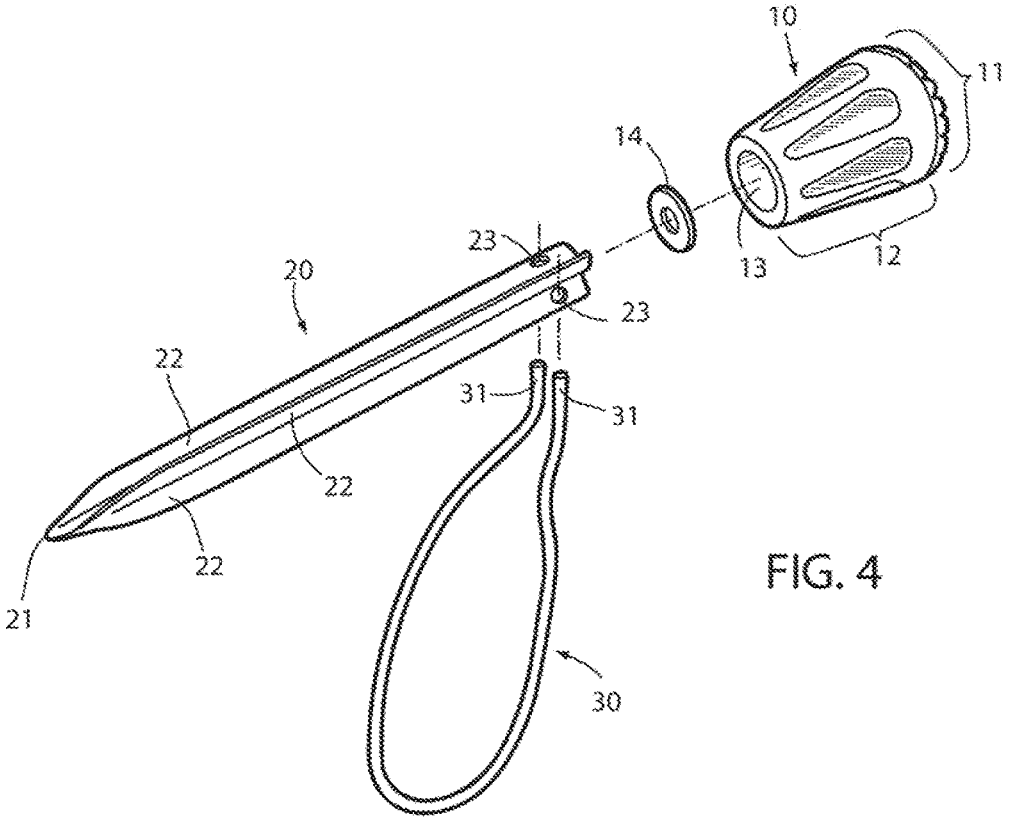
FIG. 4 is an exploded perspective view of the protective device of FIG. 1.

Grip 10 is made of rubber or similar polymer having a nonslip surface. It comprises a top wall 11 with a cylindrical skirt wall 12 depending therefrom so as to define an interior socket 13 (FIGS. 1, 4). Socket 13 which snugly receives stake 20. Preferably, socket 13 has a uniform interior diameter of from about ¼ to about ½ of an inch, preferably about ⅜ of an inch. Preferably, socket 13 has a depth of approximately ½ inch to 1 inch, most preferably about ¼ of an inch. A metal insert 14, such as a washer, is inserted into or is embedded in socket 13 at the base of socket 13, such that when stake 20 is inserted into socket 13, the end of stake 20 abuts metal insert 14, preventing stake 20 from being pushed through rubber top wall 11. Grip 10 is preferably sufficiently long to provide a firm anchor for stake 20, yet sufficiently short that both the grip and the projecting portion of stake 20 can fit concealed within the user's closed fist (FIGS. 6 and 7). Similarly, the length of grip 10 is such that a person's grip can be closed around it with a portion of stake 20 extending from between the fingers of the user's hand as shown in FIG. 9. Most preferably, grip 10 has a length of about 1⅜' of an inch from the top of top wall 11 to the base of skirt wall 12 and a diameter of about 1 inch at its widest diameter, which occurs where top wall 11 joins to circumferential skirt wall 12. More broadly, slightly smaller or somewhat larger dimensions of diameter and length dimensions could be used. For persons with larger hands, for example, a diameter of 1½ inch might be preferred, as well as an overall length of approximately 2 inches.

Top wall 11 of grip 10 is preferably slightly rounded. Its surface is also preferably roughened or dimpled by providing a plurality of dimples 11*a* (FIG. 1). This gives the surface top wall 11 additional grip against a user's thumb or the palm of a user's hand. Similarly, cylindrical skirt wall 12 includes a plurality of longitudinal grooves 12*a* (FIGS. 1, 2) to enhance gripping contact between a user's fingers and palm and grip 10. While the diameter of socket 14 is uniform throughout its length, the exterior of cylindrical skirt wall 12 tapers from its widest point at its junction with top wall 11, downwardly and inwardly as it proceeds away from top wall 11. The thickness of skirt wall 12 at its junction with top wall 11 is about ¼ to ⅜ inch, and at its terminus remote from top wall 11 is approximately ⅛ inch.

Figure 3:
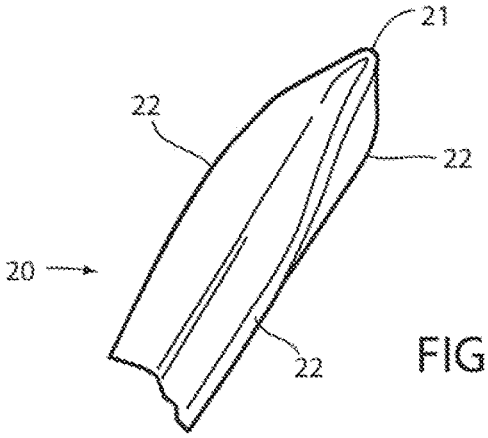
FIG. 3 is an enlarged perspective view of the blunt point of the protective device of FIGS. 1 and 2.

Stake 20 is made of a rigid material, such as metal or of a rigid plastic. Preferably, stake 11 is extruded. Most preferably, it is made of extruded aluminum. At its end, stake 20 tapers to a blunt point 21. Point 21 (FIG. 3) must be sufficiently pointed that when it is jammed into a person it will inflict pain, or when used for example on the ice, will gain slight penetration of the ice surface. Yet, it is sufficiently blunt that it will not significantly penetrate, slice or cut a person's skin when punched into or dragged across the person's skin.

Throughout its length, stake 20 must have a smooth contact surface which engages the user's skin, such that it can be held and manipulated without cutting the user. One must be able to slide device 1 from its concealed position as shown in FIG. 7, to its projecting position shown in FIG. 8, without slicing the user's skin. Thus stake 20 should not have any sharp edges which would cut into a user's hand. Preferably, stake 20 comprises a plurality of ribs 22 (FIGS. 2, 4), preferably 3, to give it rigidity while minimizing the quantity of material used. Each rib 22 has a rounded, non-sharp edge.

Stake 20 includes two holes 23 at its end opposite point 21 (FIG. 4). One hole 23 is located in one rib 22 and the other hole 23 in another of the ribs 22. Holes 23 are adapted to receive the ends 31 of loop 30, to facilitate the secured lent of loop 30 to protection device 1.

Figure 5:
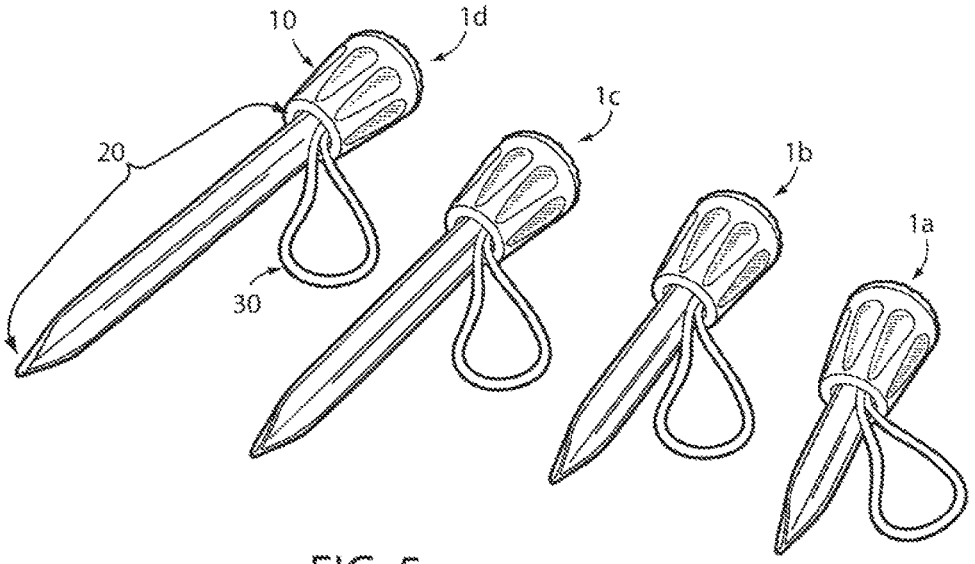
FIG. 5 is a perspective view of the preferred embodiment protective devices of varying lengths.

Preferably the length of stake 20 is such that protective device 1 as a whole has a length approximately equal to the width of a person's hand at the juncture of the palm and fingers (FIG. 6). Persons with larger hands will want a protective device 1 with a longer stake 20. Thus preferably, the overall length of protective device 1 varies from about 3 to about 5 inches. FIG. 5 shows four protective devices 1*a* through 1*d* with different overall lengths of about 3 inches, inches, 4 inches and 4½ inches, respectively.

Figure 8:
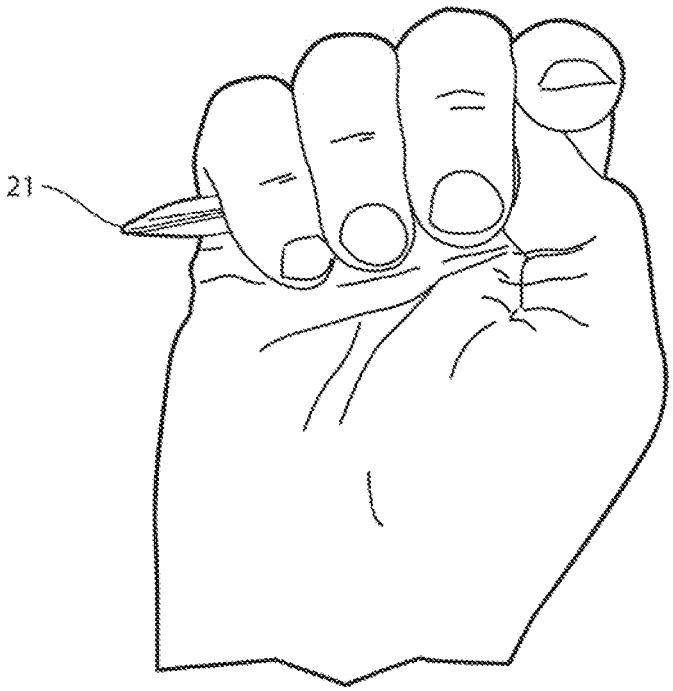
FIG. 8 is a perspective view showing a user's hand closed over a protective device, but with the device having been pushed by the user's thumb such that the blunt pointed end of the protective device is exposed.

Loop 30 is preferably made of a strong, flexible cord material. It should be sufficiently large in diameter that it does not cut into a person's skin when protective device 1 is being used. The length of loop 30 is sufficient that in use, it fits easily and somewhat loosely over a person's finger. It should be sufficiently short that it keeps protective device 1 generally within the confines of a user's palm when resting laterally across the user's palm. Yet, it should be sufficiently long that it allows a user to extend the blunt point 21 of stake 20 from a position completely concealed within a user's fist as shown in FIG. 7, to a position extending from the base of the user's grip as shown in FIG. 8. This is accomplished by the user engaging top wall 11 with his or her thumb and pushing protective device 1 downwardly relative to the thumb, thus extending the point 21 of stake 20 beyond the width of the grip as shown in FIG. 8. Similarly, loop 30 should be sufficiently long that one can readily change the orientation of protective device 1 in the user's hand, from that shown in FIGS. 6-8 to that shown in FIG. 9, without having to remove loop 30 from the user's finger in order to do so.

To assemble protective device 1 the ends 31 of loop 30 are inserted through their respective holes 23 in the end of stake 20. Glue is applied at the end of stake 20 to hold the ends 31 of loop 30 in place at the end of stake 20. Glue is similarly located within socket 13, and the end of stake 21 is then inserted into socket 13. The glue holds stake 20 firmly in place within socket 13. The ends of loop 13 are now firmly embedded within socket 13 of grip 10 such that the loop 30 extends outwardly from socket 13, adjacent stake 20 (FIGS. 1, 2).

Protective device 1 can be conveniently carried, on a key chain 40 by using loop 30 to connect to key chain 40 (FIG. 11). Protective device 1 can also be conveniently carried in a cup holder 50 of a user's automobile (FIG. 10). In use, protective device 1 can be oriented laterally across a user's palm, generally at the juncture of the fingers and palm (FIG. 6), with the user's hand then closed in a fist around protective device 1 as shown in FIG. 7. Protective device 1 can be oriented such that the user's thumb is resting against the top wall 11 of grip 10 as shown in FIGS. 6-7 such that if it must be used, the user can simply press his or her thumb against top wall 11 of grip 10, thereby forcing blunt point 21 to project slightly from the base of the user's fist as shown in FIG. 8.

Alternatively, protective device 1 can be oriented with the top wall 11 of grip 10 resting against the portion of the palm at the base of the user's thumb, and with stake 20 projecting from between the user's fingers (FIG. 9).

Protective device 1 is useful in various situations. It can be used to repel an assailant. For example, if an assailant reaches around a person from behind to grab them, the user can extend point 21 of stake 20 and drive it into the back of the assailant's hand, thereby inflicting surprise and pain on the assailant in the case of a frontal assault by an assailant, the user might prefer to use a jabbing motion and orient protective device 1 with stake 20 projecting from between the fingers as shown in FIG. 9. Thus with a quick jabbing motion the user can jab the point into some portion of the assailant's body or head.

It would also be useful for a user to carry one or two protective devices 1 in his or her pockets when ice skating on a pond. If the ice were to break underneath the person, the person could use protective device 1 in the manner shown in FIG. 8 to jamb point 21 into the ice surrounding the break, thus assisting the user in pulling himself or herself out of the hole and onto the ice shelf surrounding the hole.

Protective device 1 thus provides a compact an easily carried device for protection against assailants and for other such uses, as for example a safety device when ice skating. It contains no sharp point or sharp edges and hence is more likely to be a device which a person can carry on to an airplane. It can be conveniently concealed within a user's grip, yet readily shifted so as to project from the user's grip either from the base of the fist or between the user's fingers, and thence used to inflict pain on any would-be assailant.

Of course, it is understood that the foregoing is a description of the preferred embodiments and methods of use, and that variations in the device and in its methods of use can be made without departing from the spirit and broader aspects of the invention.

The invention claimed is:

1. A protective device comprising: a grip; a stake projecting from said grip and terminating in a point; and a flexible loop projecting from said grip, said loop being sufficiently long that a user can loop it over a finger to attach the device to the user's hand, and such that it allows repositioning of the device in a user's palm, whereby the device can be generally concealed within a user's palm, but shifted within his or her palm such that said point of said stake is exposed and can be directed against an attacker to inflict pain and discourage further advances; said grip having a top, a skirt projecting downwardly from said top and defining a socket with an opening at the base of said grip; said stake being located within said socket, and projecting from said grip opening; said loop being secured to said stake within said socket, and also projecting from said grip opening.

2. The protective device of claim 1 comprising: said protective device having an overall length such that it extends laterally across a portion of the width of a user's hand at the palm and fingers, but can be substantially concealed within the user's closed fist.

3. The protective device of claim 2 comprising: the length of grip being such that a person's hand can be closed around it with a portion of said stake extending from between the fingers of the user's hand.

4. The protective device of claim 3 an overall length of from about 3 to about 5 inches.

5. The protective device of claim 3 comprising: said point of said stake being blunt, sufficiently pointed that when it is jammed into a person it will inflict pain, yet is sufficiently blunt that it will not significantly penetrate, slice or cut a person's skin when punched into or dragged across the person's skin.

6. The protective device of claim 5 comprising: said stake having a smooth contact surface throughout its length, such that it can be held and manipulated without cutting the user.

7. The protective device of claim 6 comprising: said stake comprising a plurality of longitudinal ribs.

8. The protective device of claim 5 comprising: said grip being sufficiently long to provide a firm anchor for said stake within said socket, yet sufficiently short that both said grip and the projecting portion of said stake can fit concealed within a user's closed fist.

9. The protective device of claim 8 comprising: said top of said grip being slightly rounded, and having a roughened or dimpled surface.

10. The protective device of claim 9 comprising: said skirt of said grip including a plurality of longitudinal grooves to enhance gripping contact between a user's fingers and palm and said grip.

11. A protective device comprising: a grip; a stake projecting from said grip and terminating in a point; and a flexible loop projecting from said grip, said loop being sufficiently long that a user can loop it over a finger to attach the device to the user's hand, and such that it allows repositioning of the device in a user's palm, whereby the device can be generally concealed within a user's palm, but shifted within his or her palm such that said point of said stake is exposed and can be directed against an attacker to inflict pain and discourage further advances; said point of said stake being blunt, sufficiently pointed that when it is jammed into a person it will inflict pain, yet is sufficiently blunt that it will not significantly penetrate, slice or cut a person's skin when punched into or dragged across the person's skin.

12. The protective device of claim 11 comprising: said grip being sufficiently long to provide a firm anchor for said stake within said socket, yet sufficiently short that both said grip and the projecting portion of said stake can fit concealed within a user's closed fist.

13. The protective device of claim 12 comprising: said grip being made of rubber or similar polymer and having a nonslip surface.

14. The protective device of claim 13 comprising: said grip having a length of about 1⅜ to about 2 inches from said top to the base of said skirt and a diameter of about 1 to 1½ inch at its widest diameter.

15. The protective device of claim 14 having an overall length of from about 3 to about 5 inches.

16. The protective device of claim 15, comprising: a metal insert embedded in said socket at said top wall, such that when said stake is inserted into said socket, the end of said stake abuts said metal insert, preventing said stake from being pushed through said top wall.

17. A protective device comprising: a grip; a stake having an anchored portion anchored in said grip, and a projecting portion projecting from said grip and terminating in a point; and a flexible loop projecting from said grip, said loop being sufficiently long that a user can loop it over a finger to attach the device to the user's hand, and such that it allows repositioning of the device in a user's palm, whereby the device can be generally concealed within a user's palm, but shifted within his or her palm such that said point of said stake is exposed and can be directed against an attacker to inflict pain and discourage further advances; said grip having an interior socket receiving the anchored portion of said stake, and said grip being sufficiently long to provide a firm anchor for said stake within said socket, yet sufficiently short that both said grip and the projecting portion of said stake can fit concealed within a user's closed fist.

18. A protective device comprising: a grip; a stake projecting from said grip and terminating in a blunt point; and a flexible loop projecting from said grip, said loop being sufficiently long that a user can loop it over a finger to attach the device to the user's hand, and such that it allows repositioning of the device in a user's palm, whereby the device can be generally concealed within a user's palm, but shifted within his or her palm such that said point of said stake is exposed and can be directed against an attacker to inflict pain and discourage further advances; said grip having a top, a skirt projecting downwardly from said top and defining a socket with an opening at the base of said grip; said stake being located within said socket, and projecting from said grip opening; said loop being secured to said stake within said socket, and also projecting from said grip opening; said grip having a length of about 1⅜ to about 2 inches from said top to the base of said skirt and a diameter of about 1 to 1½ inch at its widest diameter; and said protective device having an overall length of from about 3 to about 5 inches.

19. The protective device of claim 18 comprising: said grip being made of rubber or similar polymer and having a nonslip surface; said stake having a smooth contact surface throughout its length, such that it can be held and manipulated without cutting the user.

* * * * *